United States Patent [19]

Blaudszun

[11] Patent Number: 4,474,199

[45] Date of Patent: Oct. 2, 1984

[54] CLEANING OR STRIPPING OF COATED OBJECTS

[75] Inventor: Bernd Blaudszun, Hamburg, Fed. Rep. of Germany

[73] Assignee: L'Air Liquide, Societe Anonyme pour l'Etude et l'Exploitation des Procedes Georges Claude, Paris, France

[21] Appl. No.: 440,433

[22] Filed: Nov. 9, 1982

[30] Foreign Application Priority Data

Nov. 17, 1981 [DE] Fed. Rep. of Germany ..... 3145815

[51] Int. Cl.[3] ..... B08B 7/02

[52] U.S. Cl. ..... 134/105; 134/1; 134/21; 134/38; 134/107

[58] Field of Search ..... 202/170; 134/105, 122 R, 134/122 P

[56] References Cited

U.S. PATENT DOCUMENTS

| | | | |
|---|---|---|---|
| 2,466,769 | 4/1949 | Herold et al. | 134/105 X |
| 3,085,948 | 4/1963 | Kearney | 202/170 |
| 4,185,649 | 1/1980 | Germain | 134/122 R |

FOREIGN PATENT DOCUMENTS

| | | |
|---|---|---|
| 235548 | 4/1909 | Fed. Rep. of Germany . |
| 2541613 | 2/1977 | Fed. Rep. of Germany . |

*Primary Examiner*—Robert L. Bleutge

*Attorney, Agent, or Firm*—Young & Thompson

[57] ABSTRACT

The present invention relates to the cleaning or stripping of coated objects. The coating is dissolved in a receiver tank rendered inert by means of nitrogen, by a solvent and the mixture of solvent and coating product is transferred into a thickening tank swamped by a heated nitrogen flow. The nitrogen-solvent mixture is separated by cooling and condensation of the solvents extracted. The invention is applied to the stripping of objects coated with paints and varnish.

9 Claims, 1 Drawing Figure

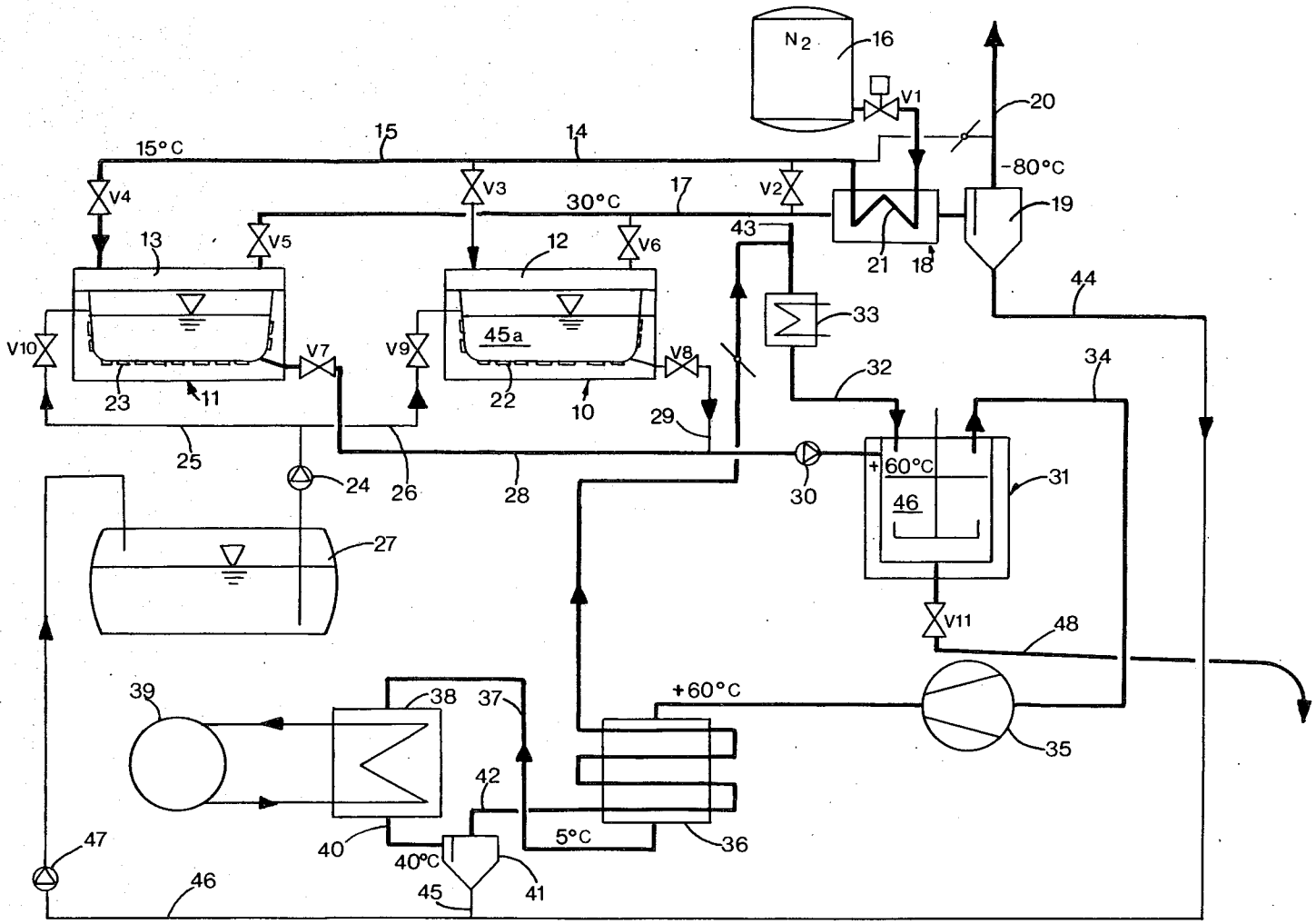
N2
-80°C
+60°C
30°C
15°C
5°C
40°C
45a
46

CLEANING OR STRIPPING OF COATED OBJECTS

BACKGROUND OF THE INVENTION

The present invention relates to apparatus for cleaning or stripping coated objects, in particular painted or varnished objects, by immersion in a bath of solvent.

There are several methods of stripping painted or varnished objects, one of these being based on pyrolysis, meaning incineration of the varnish layers at temperatures between 500° C. and 700° C. Its disadvantages are a large power consumption, a thermal load inflicted on the objects, difficulties in handling the objects, as well as diffusion of substantial quantities of noxious substances into the atmosphere. Another known method utilises sanding to remove layers of varnish. This method requires comparatively long periods and raises problems regarding removal of the varnish sanding products. Furthermore, the storage of the varnish requires an isolated store. Another known method consists in stripping the varnish by exposing the objects to a jet of high-pressure steam. In this case too, the quantity of energy required is comparatively substantial and a separate store is needed for storage.

Stripping by means of ultrasonics is also known, with the objects which are to be stripped immersed in a solvent bath, which is performed under a normal atmosphere. In this case, the power needed is not as great as in the case of the methods described earlier, but a drawback still persists regarding the environment, deriving from storage of the varnish removed which is still partially charged with solvent. Given that the solvent is inflammable at comparatively low temperatures, there is a very great risk of the solvent bursting into flames or exploding.

Finally, stripping methods in the cold state and in the hot state have been developed, based on processes exploiting special chemical products which for their part give rise to storage problems. Furthermore, the quantities of chemical products required are considerable and the duration of the process is comparatively long.

Consequently, it is an object of the invention to provide apparatus for removing the detachable layers from objects coated therewith, in particular for stripping varnished objects, which despite low operating costs does not produce waste, does not require more than a low consumption of initial material and engenders an emission into the atmosphere which is no more than slight and negligible.

SUMMARY OF THE INVENTION

In accordance with the invention, this and other objects are achieved by apparatus in to which the objects are inserted into a closed tank and are treated with a liquid fluid, the mixture of processing fluid and substance stripped then being collected, the processing fluid being separated from the substance stripped, inert gas being fed into the tank after completion of the operation for removal of the coatings, and the gas issuing from the tank being condensed to separate the processing fluid released, wherein coated objects are inserted into the hermetically sealed tank, inert gas is fed into the said tank until a residual proportion of oxygen of 3% by volume is established, the gas emerging from the "passivating" tank heats the inert gas fed into the tank by heat exchange, and wherein after the passivating action, a stripping product is fed into the tank in which are immersed the objects which are to be stripped, and after the stripping operation and prior to drying the objects stripped, the mixture of coating and stripping product or stripper is pumped out of the tank, the gaseous mixture emerging from the tank during the drying operation is cooled by the inert gas fed into the tank by heat exchange prior to condensation of the stripper, and the inert gas is vented into the atmosphere after condensation of the stripper.

The elimination of the coatings, for example the stripping of a varnish, is performed by means of a solvent known per se, but in accordance with the invention, the method is thus applied under an inert atmosphere. Any risk of fire or explosion is thus substantially avoided during the stripping of the coating. Once the stripping operation has been performed, the inert gas may be discharged into the atmosphere, if desired whilst passing through an appropriate separator device, without any noxious substances being carried along. The inert gas utilised in the process for elimination of the layers also serves the purpose of separating the solvent and the material forming the protective coating. To this end, the inert gas exhausts the vaporised solvent and carries into an appropriate device for condensation. The solvent separated may then be used again in the processing operation, the utilisation of pollutant and troublesome chemical products being kept within very small limits by virture of this fact during application of the method.

Upon separating the solvent from the mixture of solvent and coating substance, it is possible to obtain an appropriate concentration of this mixture, to render the same reusable. For example, this is so in the case of elimination of varnish. The varnish mixed with the solvent may be re-used at the required concentration for another varnishing operation, to obtain pigments, etc . . . Channelling the same to a particular outlet is prevented in this manner, and the resultant environmental pollution is averted.

Nitrogen is advantatageously used as the inert gas in one version of the method forming the object of the invention. Given that it is an industrial gas easy to handle, nitrogen may be utilised in particularly advantageous manner in the method of the invention.

The entrainment of vaporised solvent by inert gas escaping from the bath cannot be prevented altogether. Consequently, in accordance with the invention, provision is made for the gas escaping from the bath to be cooled by heat exchange with the inert gas fed thereinto. If, for example, gaseous nitrogen is withdrawn from a tank under pressure containing liquid nitrogen, the temperature of the gaseous nitrogen drops since it is denuded of the heat of vaporisation. If the nitrogen fed in is then heated by heat exchange, this results in cooling the mixture of nitrogen and solvent vapor. The solvent vapor may condense by virture of this fact, and the liquid condensate may be collected whilst pure nitrogen escapes into the atmosphere.

When the mixture of solvent and coating substance has been extracted from the bath, the objects stripped are still impregnated with solvent. For this reason and in accordance with another feature of the invention, it is proposed that upon withdrawing the mixture of solvent and coating substance from the bath, the objects stripped be dried with inert gas and that the solvent be separated from the flow of inert gas and solvent vapor and be collected.

The stage of the method described last is implemented in the manner described above.

As has already been stated, the inert gas is used to separate the solvent from the coating substance. To this end and according to an inventive feature, provision is made to heat the inert gas for evaporating the solvent. As a modification, it is possible to heat the tank into which is pumped with mixture of solvent and coating substance. In the case in which nitrogen is utilised as the inert gas and use is made of a conventional solvent, the heating action applies up to a temperature of approximately 60° C.

To assure better exploitation of the energy of the separation method based on condensation and according to another form of the invention, provision is made to cool the mixture of solvent vapor and inert gas by heat exchange with the colder inert gas released after condensation of the solvent vapor.

The inert gas serving the purpose and evaporating and condensing the solvent, is preferably kept within a closed loop, the required quantity of inert gas being reduced to a minimum by virtue of this fact. Prior to the separating action, the product flowing within the loop will preferably be passivated by means of an inert gas.

As will be apparent from the preceding statements, the apparatus of the invention is characterised by an optimum reutilisation of the initial materials utilised. There is virtually no scrap production leading to very low processing costs. The quantities of products given off as a result of the method forming the object of the invention lie distinctly below the recommendations made by the authorities. The quantities of energy required for application of the inventive method are very small. By virtue of a handling operation on the solvent which occurs only with an inert atmosphere, job safety is distinctly better than average, the risk of fire and explosion being reduced substantially. The effects imposed on the working stations as regards noise and other trouble amount to a minimum. Finally, the inventive method may be automated to a large extent.

A variety of appropriate apparatus is possible. An inventive apparatus comprising a tank receiving the objects and capable of being connected to a tank of inert gas via a feed pipe and a check valve, and a tank of stripping agent connected to said tank, is characterised in that the tank may be sealed hermetically and may be connected to the atmosphere via a second check valve, an exchanger and a condenser, that the inert gas tank is connected to said tank via the exchanger, that the stripper tank is connected to said tank via a pump and that another pump is provided for pumping the mixture of stripper and varnish out of the tank.

The apparatus forming this object of the invention renders it possible to "passivate" the stripping tank prior to filling the same with solvent, and to dry the objects stripped when the mixture of solvent and coating substance has been extracted. The check valves are shut between these stages of the method, which allows of keeping the quanity of inert gas required for a method of this kind at a comparatively low value. The leaks of inert gas into the atmosphere, particularly during the drying stage, do not represent any disturbance of the environment, since the appropriate precautions render it possible to separate the solvent contained therein in the form of vapor.

The heat exchanger of the apparatus of the invention preferably comprises an evaporator of a refrigerating set. This evaporator provides adequate cooling of the gaseous mixture formed by the solvent vapor and by the inert gas, such that the solvent vapor may be condensed and separated, the cooled inert gas being conveyed if desired into the thickener tank via a duct and possibly being utilised for cooling in a recuperator coupled to the evaporator.

The solvent separated may be returned into the solvent tank via appropriate pumps, and may be re-used. The mixture of solvent and coating substances concentrated in the thickener tank may also be re-used.

BRIEF DESCRIPTION OF THE DRAWINGS

In order that the invention may be more clearly understood, reference will now be made to the single FIGURE of the accompanying drawing which diagrammatically illustrates one example of apparatus for carrying out the inventive method, by way of example.

DETAILED DESCRIPTION OF THE PREFERRED EMBODIMENT

Referring to the drawing two tanks 10 and 11 are provided, which are sealed hermetically by covers 12 and 13 respectively. The tanks 10 and 11 may be connected to a nitrogen tank 16 via feed pipes 14 and 15 and check valves V3 and V4. The outlet of the nitrogen tank 16 may be shut off directly by means of a check valve V1. The tanks 10 and 11 may be connected to the atmosphere via valves V6 and V5, a pipe 17, an exchanger 18, a separator 19 and a pipe 20. A coil 21 forming part of the feed pipe 14 is located in the exchanger 18.

The tanks 10 and 11 are stripping tanks which are complementarily equipped with ultrasonic generators, as indicated schematically at 22 and 23. The tanks 10 and 11 may be connected to a solvent tank 27 via a pump 24, pipes 25 or 26 and valves V9 and V10.

The tanks 10 and 11 may be connected to a thickening tank 31 via check valves V8 and V7, pipes 28 and 29 and a pump 30. The feed pipe 32 leading to the thickening tank 31 is provided with a heating device 33. A blower 35 is situated in an extractor pipe 34 coming from the thickening tank 31. Starting from the output side of the blower 35, the pipe 34 is directed to the inlet of a recuperator 36 one of the outlets of which is connected to the evaporator 38 of a refrigerating set denoted by 39 as a whole, by means of a pipe 37. An outlet pipe 40 of the evaporator 38 is connected to a separator 41. A pipe 42 emerging from the separator 41 passes through the recuperator 36 and is connected to the pipe 32 upstream of the heating device 33. The pipe 14 is connected to the pipe 37 or 32, via a pipe 43.

The separators 19 and 41 are equipped with outlet pipes 44 or 45 leading to a manifold pipe 46 which comprises a pump 47 and which is connected to the solvent tank 27.

In the lower section, a pipe 48 comprising a valve V11 is connected to a thickening tank 31.

The apparatus described operates as follows:

The cover 12 being open, the pieces which are to be stripped are suspended manually within the stripping tank 10. After filling the same, the tank 10 is sealed tight. The valves V1, V3 and V6 are then opened. The nitrogen penetrates into the tank 10, emerges again from the latter into the open air whilst traversing the exchanger 18 and the separator 19. Air is extracted at the same time. As soon as the proportion of oxygen reaches a lower value than 3% by volume, the valves V3 and V6 are closed. At the same time, or immediately afterwards, the pump 24 is engaged and the valve V9 opened, solvent being pumped into the stripping tank 10 as shown at 45*a*. Once a predetermined filling level is reached, the valve is reclosed and the pump 24 is stopped.

The stripping process is then initiated by means of ultrasonics.

At the same time, or later, the valve V2 is opened, which renders it possible to "passivate" the condensation loop comprising the heating device 33, the thickening tank 31, the recuperator 36, the evaporator 38, the separator 41 as well as the corresponding pipes.

The valve V2 is closed again when a predetermined oxygen concentration is reached. The heating device 33 is turned on until a predetermined temperature is reached.

When the stipping stage is completed, the valve V8 opens and the pump conveys the mixture containing dissolved varnish and solvent into the thickening tank 31. The mixture is denoted by 46 in the thickening tank 31. The valves V3 and V6 open at the same time or later. The flow of nitrogen traversing the tank 10 dries the pieces cleaned. The mixture of solvent vapor and nitrogen passes through the exchanger 18. The solvent is condensed in this exchanger and is separated in the separator 19. The purified nitrogen escapes into the atmosphere via the pipe 20. The solvent coming from the separator 19 passes into the solvent tank 27 via the pipe 44 and by means of the pump 47.

After completion of the drying stage, the tank 10 is filled with air. As soon as the oxygen concentration reaches at least 19% by volume, the cover 12 opens automatically and the pieces stripped and cleaned may be withdrawn. The stripping stage may then be repeated in the manner described above.

In the meanwhile, the thickening stage progresses as follows in the tank 31. The conditioned nitrogen evaporates a part of the solvent in the thickening tank 31 at a temperature of, for example 60° C. The gaseous mixture of solvent and nitrogen undergoes initial cooling in the recuperator 36 by means of the blower 35 and is conveyed into the evaporator 38 in which the solvent vapor is condensed. The solvent and the nitrogen are separated in the separator 41. The nitrogen is reheated in the recuperator 36 and raised in the heating device 33 to the desirable temperature for its infeed into the thickening tank 31. The thickening stage lasts until the desirable viscosity of the varnish is reached. When the thickening stage is completed, the valve V11 opens in such manner that the varnish may be transferred into appropriate containers via the pipe 48.

The temperatures utilised in the thickening loop are shown in the FIGURE. They should not however be considered as being restrictive.

It is evident that a stripping stage may also be implemented in parallel or with a time-lag, in the tank 11.

I claim:

1. Apparatus for cleaning or stripping objects coated with varnish or paints, comprising: at least one receiver tank for receiving said objects; means for selectively sealingly closing said receiver tank; a tank of inert gas; an inert gas feed pipe having a first valve and connecting said receiver tank to said tank of inert gas; a stripping agent tank; a stripping agent feed pipe having a second valve and connecting said stripping agent tank to said receiver tank; an exhaust pipe having a third valve and connecting said receiver tank to atmosphere through a heat exchanger and a separator, said inert gas tank being connected to said receiver tank via said heat exchanger; and emptying means for selectively emptying said receiver tank.

2. Apparatus according to claim 1, wherein a first pump is provided in said stripping agent feed pipe and said emptying means comprise a second pump.

3. Apparatus according to claim 1, further comprising at least one thickening tank which is connected to said receiving tank through said emptying means; a conduit having a fourth valve and connecting said inert gas tank to said thickening tank; a discharge pipe connecting an upper part of said thickening tank to a second separator via a second heat exchanger; and means for supplying a refrigerant fluid to said second heat exchanger.

4. Apparatus according to claim 3, wherein said second heat exchanger comprises an evaporator of a refrigerating set.

5. Apparatus acccording to claim 3, further comprising a return pipe for returning inert gas freed of condensed stripping agent from said second separator into said thickening tank.

6. Apparatus according to claim 5, wherein a heating device is installed on said return pipe.

7. Apparatus according to claim 3, wherein a blower is installed in said discharge pipe.

8. Apparatus according to claim 5, wherein said discharge pipe and said return pipe are disposed in heat exchange relationship in a recuperator.

9. Apparatus according to claim 3, wherein liquid outlets of said separators are connected to said stripping agent tank via stripping agent return means comprising a third pump.

* * * * *